US007731057B2

(12) United States Patent
Evans et al.

(10) Patent No.: US 7,731,057 B2
(45) Date of Patent: Jun. 8, 2010

(54) MOIST TOWELETTE PACKAGING

(75) Inventors: Christopher T. Evans, Long Valley, NJ (US); Christopher Gieda, Long Valley, NJ (US); David Schultz, Northborough, MA (US); Paul Bertram, Franklin, MA (US)

(73) Assignee: Union Street Brand Packaging, Flanders, NJ (US)

( * ) Notice: Subject to any disclaimer, the term of this patent is extended or adjusted under 35 U.S.C. 154(b) by 0 days.

(21) Appl. No.: 11/803,055

(22) Filed: May 11, 2007

(65) Prior Publication Data

US 2007/0210098 A1 Sep. 13, 2007

Related U.S. Application Data

(62) Division of application No. 10/798,892, filed on Mar. 12, 2004, now Pat. No. 7,216,775.

(60) Provisional application No. 60/453,553, filed on Mar. 12, 2003, provisional application No. 60/457,937, filed on Mar. 28, 2003, provisional application No. 60/490,938, filed on Jul. 30, 2003.

(51) Int. Cl.
*B65H 1/00* (2006.01)

(52) U.S. Cl. ..... 221/63; 221/36; 221/37; 221/303; 221/309; 221/310

(58) Field of Classification Search ..... 221/36, 221/37, 49, 47, 307, 55, 267, 41
See application file for complete search history.

(56) References Cited

U.S. PATENT DOCUMENTS

| | | | | | |
|---|---|---|---|---|---|
| 3,843,017 | A * | 10/1974 | Harrison | ..... | 221/63 |
| 4,462,507 | A * | 7/1984 | Margulies | ..... | 221/63 |
| 4,526,291 | A * | 7/1985 | Margulies | ..... | 221/63 |
| 5,516,001 | A * | 5/1996 | Muckenfuhs et al. | ..... | 221/63 |
| 6,279,775 | B1 * | 8/2001 | Parkes et al. | ..... | 221/63 |

* cited by examiner

*Primary Examiner*—Gene Crawford
*Assistant Examiner*—Timothy R Waggoner
(74) *Attorney, Agent, or Firm*—James Creighton Wray; Meera P. Narasimhan

(57) ABSTRACT

The new invention allows for easy retrieval of fall backs and eases the initial threading process upon initial opening/use of the package. Threading is done without removing the cap. Several of the embodiments allow refills to be inserted into the canister without removing the lid/cap. The layout of the dispensing system and the geometry and shape of the dispensing orifice/aperture minimize and mitigate product fall backs. The new invention improves performance of the orifices/apertures through unique geometry and shape as well as using different materials from existing products or the combination of multiple materials. Varying orifice diameter, co-molded density and stiffness or geometry of the actual lobes defining the dispensing aperture allows the precise amount of friction to be created in the dispensing opening for selectively grabbing or releasing the towelette, thereby tearing the towelette connecting perforations at just the right time.

15 Claims, 11 Drawing Sheets

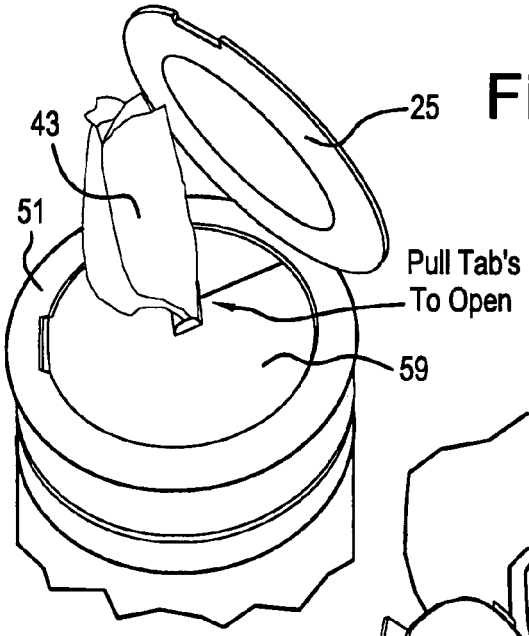
FIG. 9
FIG. 10
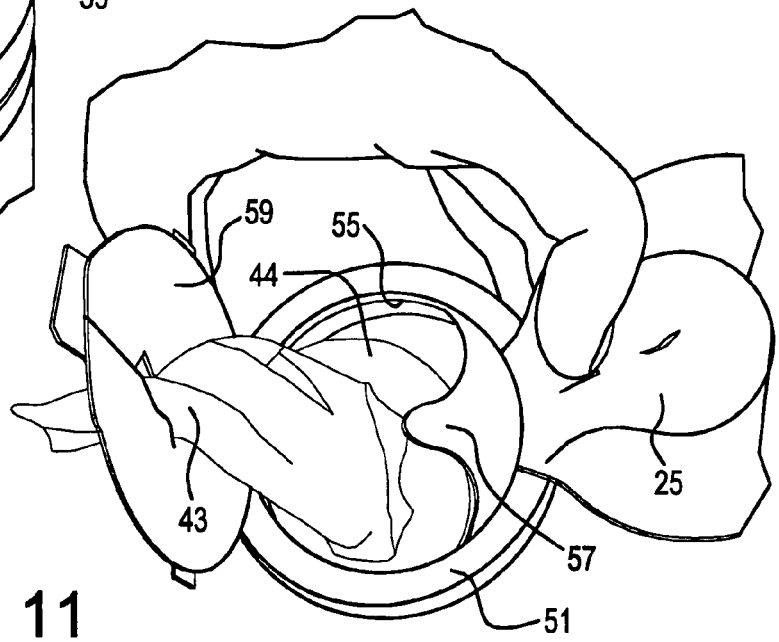
FIG. 11
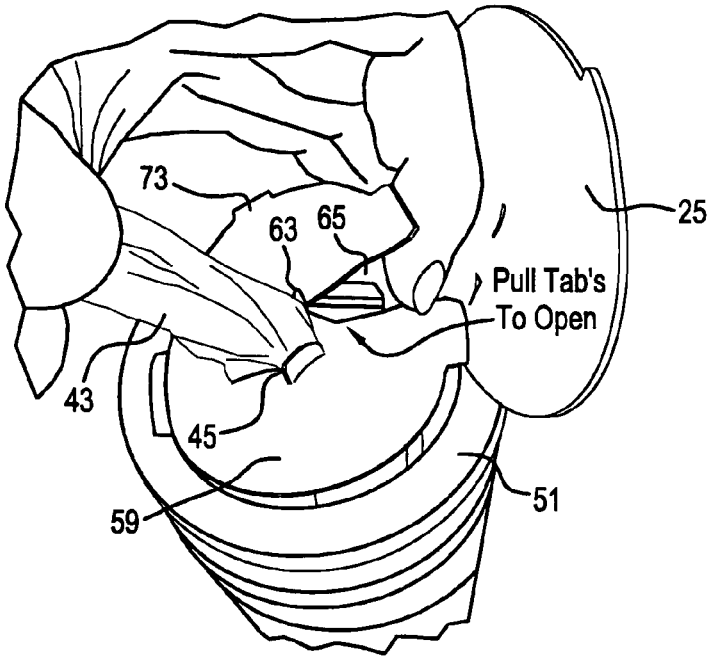

FIG. 12
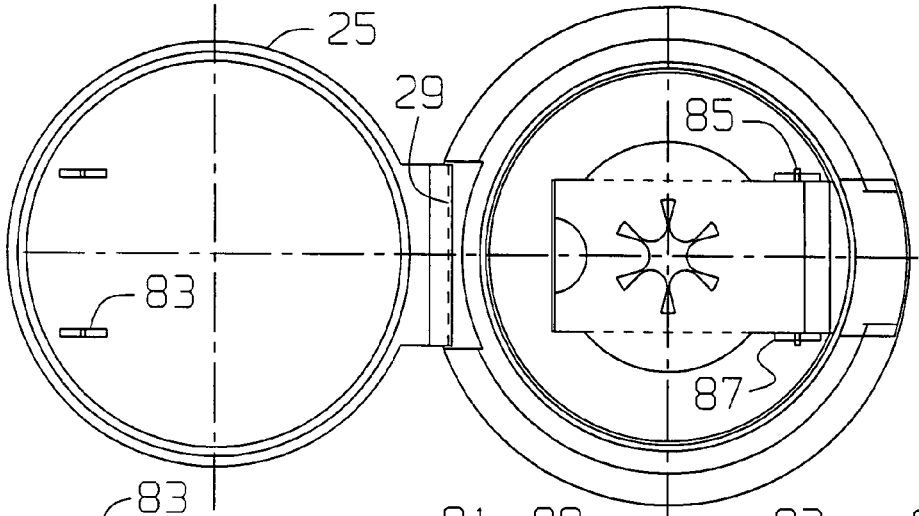
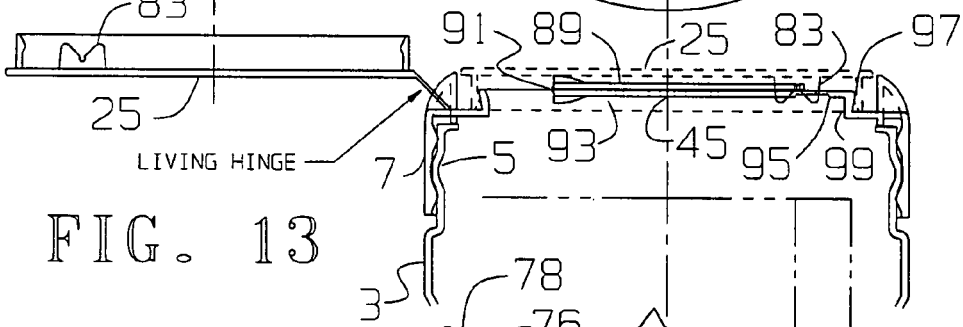
FIG. 13
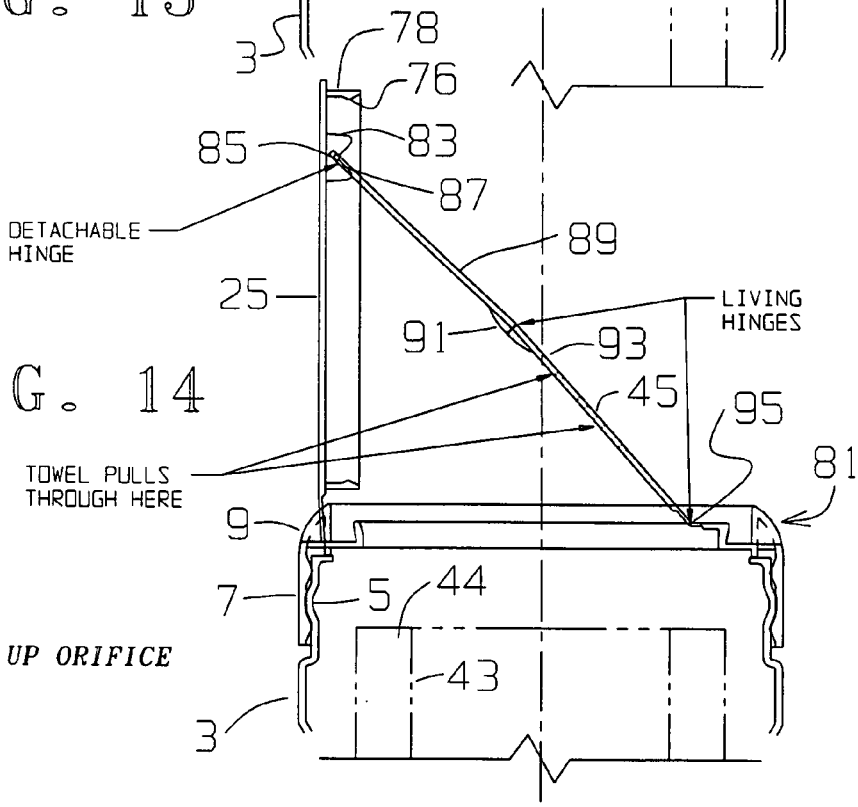
FIG. 14

TPE ORIFICE

*OFFSET ORIFICE*

*DIFFERENT LOBE DESIGNS*
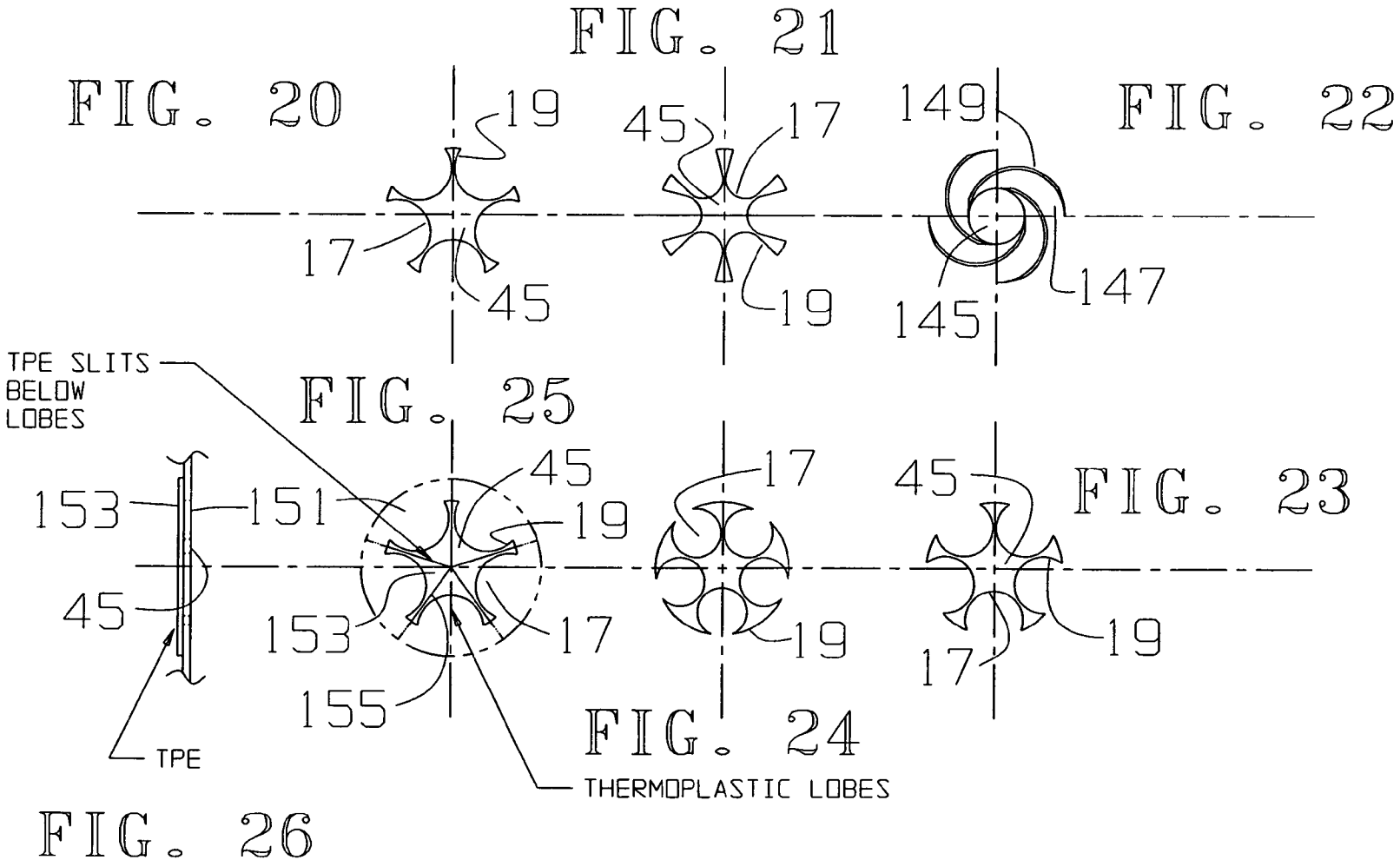

*SINGLE DOOR*

*SINGLE TRAP DOOR, WIDE OPENING.*

MOIST TOWELETTE PACKAGING

This application claims the benefit of U.S. Provisional Application No. 60/453,553 filed Mar. 12, 2003, U.S. Provisional Application No. 60/457,937 filed Mar. 28, 2003, and U.S. Provisional Application No. 60/490,938 filed Jul. 30, 2003, and is a division of U.S. Ser. No. 10/798,892 filed Mar. 12, 2004, now U.S. Pat. No. 7,215,775 issued May 15, 2007.

BACKGROUND OF THE INVENTION

Moist towelettes are commonly sold and used in consumer product markets. Many methods exist for packaging moist towelettes. However, there are no packages that have adequate dispensing mechanisms. Wipes and moist towelettes are packaged as center dispensing rolls in cylindrical containers or as stacks of individual horizontal towelettes.

Many existing packaging systems for moist towelettes either have no dispensing mechanism, or if there is a dispensing mechanism, then it has too many limitations that inhibit functionality and ease of use.

Current packages attempt to let customers remove one towelette at a time. Normally, the subsequent wipe in a package hangs out from the package for easy grasping. However, should the next wipe fall back through the orifice in the cap and into the canister, current technology requires the user to pull the cap off. This is often very difficult to do. The consumer must then re-thread the wipe through the cap orifice, and then re-apply the cap to the canister for further single towelette dispensing. This is the same activity that a consumer must go through for first dispense of the package also.

When using the moist towelettes, hands of a user often become contaminated with substances. Reopening the container, then finding and leading an end of a towelette through a dispensing orifice are difficult when the dispensing interruption occurs before completing a cleaning operation.

Needs exist for improved methods for dispensing and storing moist towelettes that allows for easy dispensing.

SUMMARY OF THE INVENTION

The new invention is intended to allow for easy retrieval of "fallbacks", as well as easing the initial "threading" process one must go through upon initial opening/use of the package. The new invention allows threading to be done without removing the cap. Also, several of the new embodiments allow refills to be inserted into the canister without removing the lid/cap. The layout of the dispensing system and the geometry and shape of the dispensing orifice/aperture minimize and mitigate product fallbacks.

The new invention improves performance of the orifices/apertures through unique geometry and shape as well as using different materials from existing products, or the combination of multiple materials, such as hard thermoplastic molded substrate surrounding the orifice structure, with co-molded rubber-like material filling the void or aperture center. Varying orifice diameter, co-molded density and stiffness or geometry of the actual lobes defining the dispensing aperture allow the precise amount of friction to be created in the dispensing opening for selectively grabbing or releasing the towelette, thereby tearing towelette connection perforations at just the right time. That maximizes dispensing performance, and does not necessarily require the user to pull the towelettes up at an angle, as is suggested by current alternative dispensers, to ensure that the user removes only one towelette at a time.

These and further and other objects and features of the invention are apparent in the disclosure, which includes the above and ongoing written specification, with the drawings.

BRIEF DESCRIPTION OF THE DRAWINGS

FIG. 9 is a perspective view of the dual lid shown in FIGS. 6-8.

FIG. 10 is an opened perspective view of the dual lid shown in FIGS. 6-9.

FIG. 11 shows adjusting the inner lid in a perspective view of the dual lid shown in FIGS. 6-10.

FIG. 12 is a plan view of a towelette access cover and pop-up orifice.

FIG. 13 is a cross-sectional elevation of the towelette access cover and pop-up orifice of FIG. 12.

FIG. 14 is an erected cross-sectional elevation of the towelette access cover and pop-up orifice of FIG. 12.

FIGS. 20-24 are plan view details of different lobe designs for towelette dispensing orifices in towelette dispenser caps.

FIGS. 25 and 26 show slitted soft thermoplastic elastomer layers below the dispensing orifice and thermoplastic lobes.

DETAILED DESCRIPTION OF THE PREFERRED EMBODIMENTS

Figures 1, 2, 3, 4, 5:
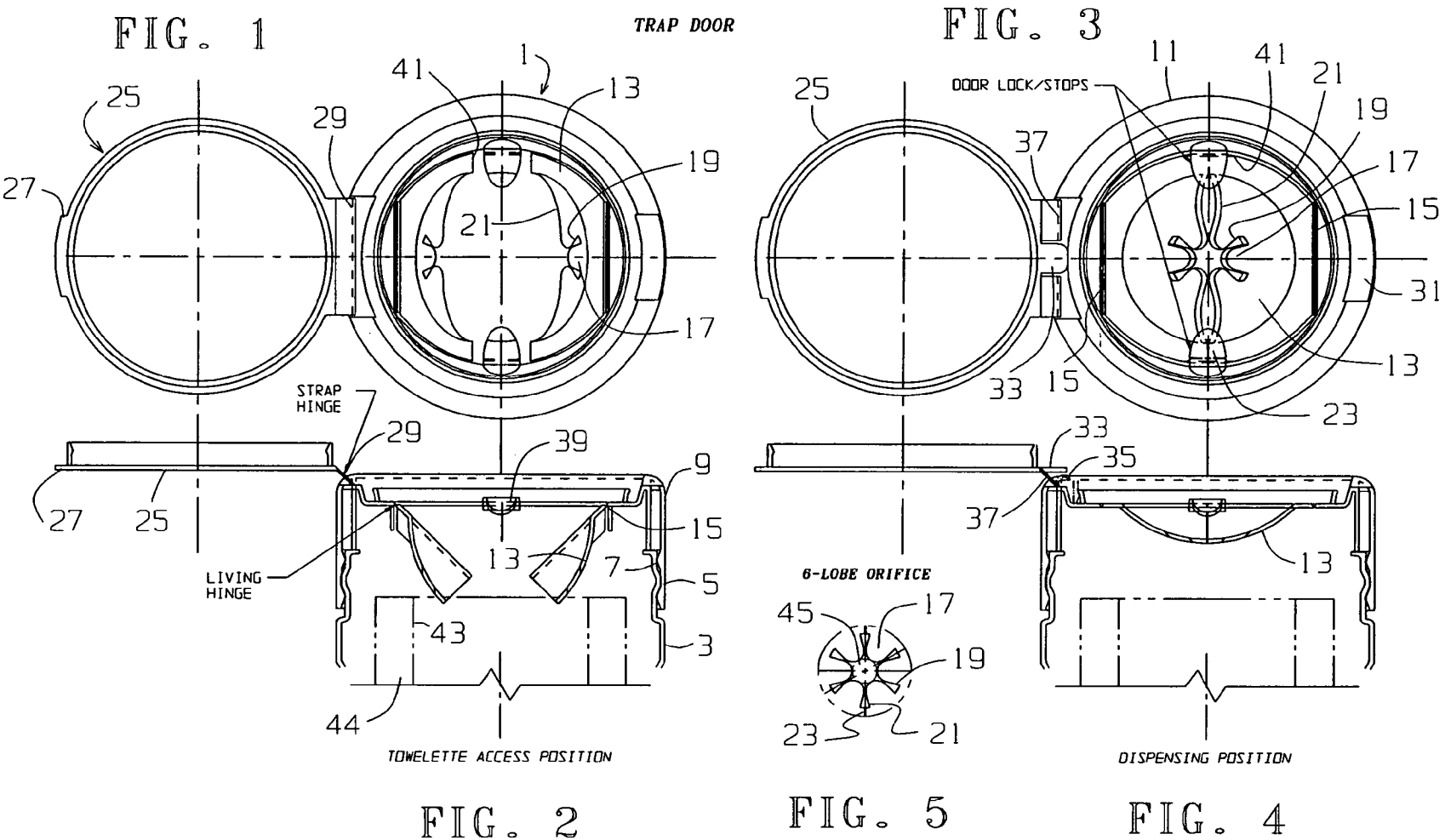
FIG. 1 is a plan view of a locking trap door embodiment in a towelette access position.
FIG. 2 is a cross-sectional elevation of the apparatus shown in FIG. 1.
FIG. 3 is a plan view of a locking trap door embodiment in a towelette dispensing position.
FIG. 4 is a cross-sectional elevation of the apparatus shown in FIG. 3.
FIG. 5 is a plan view showing a multiple lobe orifice.

Referring to FIGS. 1-4, a trap door embodiment of the invention is generally referred to by the numeral 1. A container 3 has an open upper end 5 that is configured to receive a complementary lower end 7 of the cylindrical wall 9 of the dispenser 1. The dispensing top 11 has two mirror-imaged portions 13 pivoted on living hinges 15. Each half 13 has a dish shape with product-engaging lobes 17 formed between generally radially extending recesses 19. Elongated recesses 21 are formed along the parting line 23 of the two dish-shaped halves 13. A cover 25 with a lifting tab 27 is joined with the top about a living hinge 29. The tab 27 lies within a recess 31 when closed.

In one embodiment, an inward-extending tab 33 cooperates with a rim 35 on the top of the container and extends between two living hinges 37 to assist in holding the cover 25 fully opened or fully closed. Door lock stops 39 extend inward from the central opening 41 to prevent upward travel of the dish-shaped halves 13. When accessing the inner towelette 43 in a roll 44, an index finger and a thumb push inward on the dish-shaped halves 13, which rotate around the living hinges 15 to allow pinching of the top of the innermost towelette 43, and lifting the towelette upward. The lobes 17 and radial recesses 19 and 21 allow the innermost towelette 43 to be pulled through the central opening 45.

Towelettes in the roll 44 are joined together by four or five small bridges. As the next adjacent towelette passes through the central opening 45, the lobes 17 and radial recesses 19 grip and slow the next adjacent towelette while the bridges rupture by continued pulling of the first towelette. The result is that the second towelette protrudes slightly through the opening 45 so that it may be gripped between a thumb and index finger when the next towelette is desired. Between uses, the cover 25 is snapped into closed position, retaining the moisture in the towelettes.

FIG. 5 shows an alternate form of the orifice 45 in which the radial recesses 19 and 21 in the halves 13 are of equal size, making the lobes 17 of equal size.

Figures 6, 7, 8:
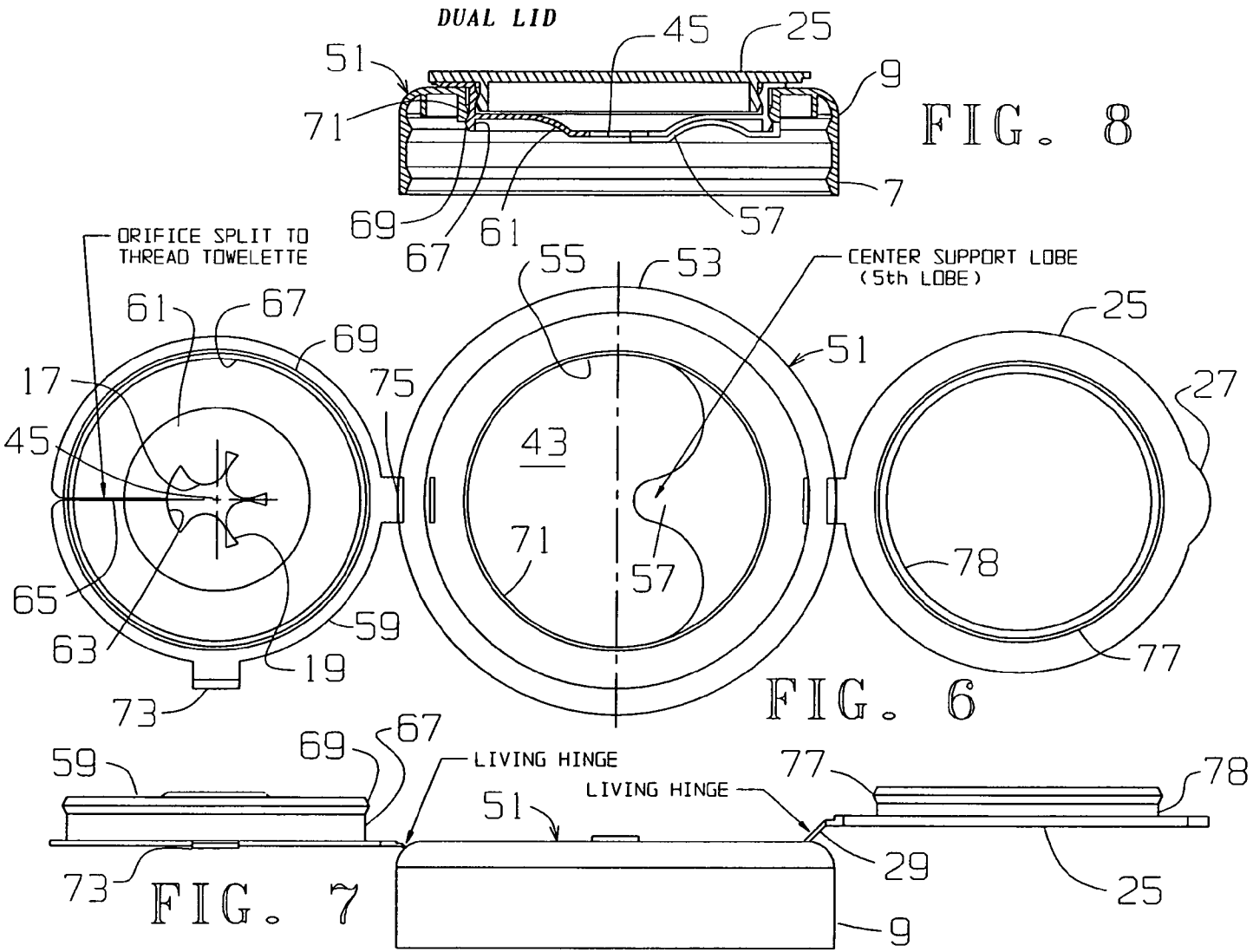
FIG. 6 is a plan view of a dual lid.
FIG. 7 is a side elevation of the dual lid shown in FIG. 6.
FIG. 8 is a closed cross-sectional elevation of the dual lid shown in FIGS. 6 and 7.

FIGS. 6-8 show a dual lid embodiment. The lower portion 7 of the cylindrical wall 9 is configured for snapping onto the moist towelette container. When the container is square or rectangular, the wall 9 and the lower end attachment are square or rectangular. The main portion 53 has a central opening 55 with a center support lobe 57, which extends into the opening. An orifice-holding lid 59 has a central-portion 61 with lobes 17 separated by radial recesses 19, and a relatively large recess 63 with a radial split 65 used to thread the towelette. A throat 67 has an outward-extending rim 69, which snaps between an inward-extending rim 71 in the central portion 53. A tab 73 is provided to lift the orifice lid 59 around living hinge 75 if required. The split 65 and the large opening 63 align over the center support lobe 57, which provides the fifth lobe which cooperates with the four other lobes 17, forming a towel-lifting opening 45 in the center. When it is necessary to reach the innermost towelette 43, pressing inward on the lobe 17 near the central lobe 57 allows the split 65 to open for reaching the innermost towelette 43. Pulling that towelette upward through the opening 45 and continuing the upward pulling of the towelette draws the next adjacent towelette partially through the opening until the towelette bridges are ruptured. The result is that the next adjacent towelette is partially extended through the opening 45, allowing the next towelette to be conveniently removed through the orifice, and holding the end of the succeeding towelette in the orifice. A cover 25 similar to the cover shown in FIGS. 1-4 is connected to the container end with a living hinge 29. A tab 27 aids in opening the cover. A rib 77 extends around an outside of the throat 78 of the cover for cooperating with an inward-extending lip 79 on the throat of the orifice-holding lid 59.

FIGS. 9, 10 and 11 are perspective views of the container end 51 with the cover 25 raised and the orifice holder 59 closed.

FIG. 10 shows an orifice holder 59 raised with the innermost towelette 43 being pulled from the towelette roll 44.

The orifice holder is shown with the slit 65 separated to aid in the lateral placement of the towelette 43 through the orifice 45.

FIG. 11 shows the closing of the orifice holder 59 while partially pulling the first towelette 43 through the orifice 45.

FIGS. 12-14 show a cap 81 of the invention with a pop-up orifice. The container 3 has an upper end 5 with a shape that is gripped by the shaped lower end 7 of the wall 9. A cover 25 is connected to the wall 9 by a living hinge 29. The cover has parallel V-shaped receiver brackets 83 on its inner surface, which receive outward-extending pins 85 on detachable hinge 87 at the outer end of the hinge plate 89. Living hinges 91 connect the hinge plate 89 to the orifice plate 93, which is in turn connected by a living hinge 95 to the top of the container. As the container is packaged, the hinge plate 89 may be folded around the living hinge 91 inward in the container. The orifice plate 93 and hinge plate 89 are lifted around the living hinge 95, and the innermost towelette 43 from the roll 44 is started through the orifice 45. Then the hinge pins 85 are connected to the V-shaped receivers 83 on the cover 25, as shown in FIG. 14. The drawing of the towelette upward through the orifice 43 draws the next connected towelette from the inner surface of the roll 44 until the bridges connecting the towelette are fractured into the resistance of the orifice 45. The cover 25 is closed, folding the hinge plate 89 around the living hinge 91 on top of the orifice plate 93 as the cover is closed, as shown in dashed lines in FIG. 13. An inner lip 76 on the throat 78 of the cover snaps around an outward projection 97 at the inner portion of the orifice holder plate 99, which holds the living hinge 95 in the cap 81.

Figure 16:
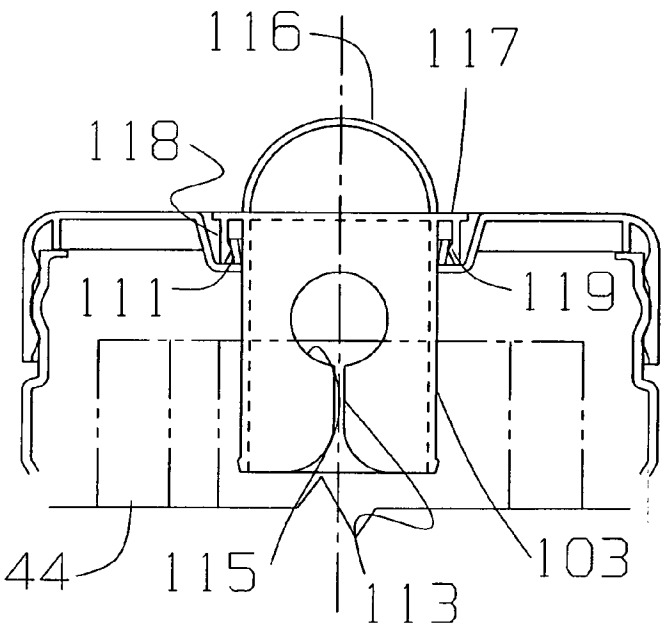
FIG. 16 is a cross-sectional elevation of a telescoping dispenser orifice for towelettes in a closed position.
Figure 15:
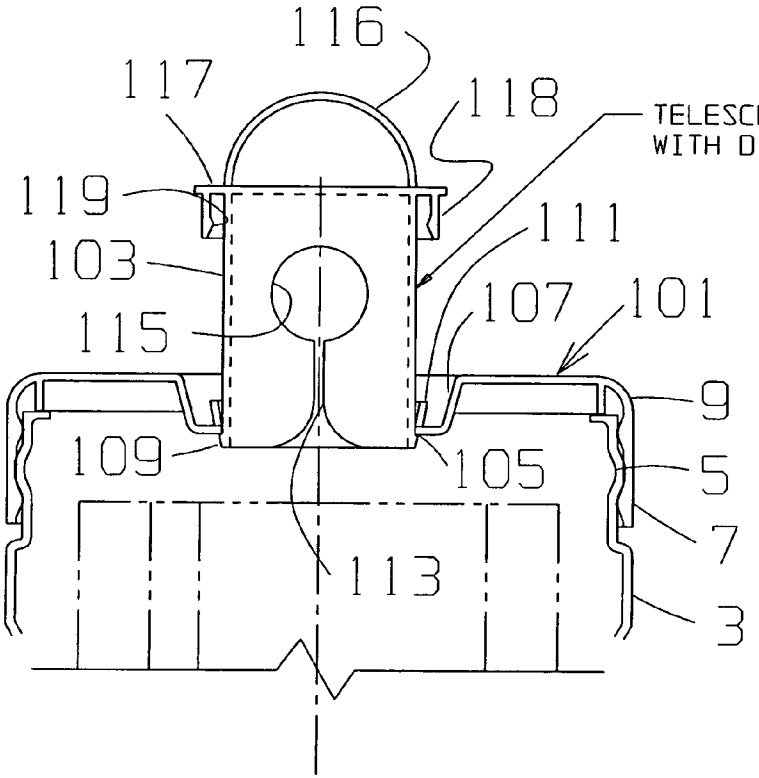
FIG. 15 is a cross-sectional elevation of a telescoping dispenser orifice for towelettes in an extended dispensing position.

FIGS. 15 and 16 show a cap 101 with a telescoping member 103, which fits through a central opening 105 in a central recess 107. A rim 109 at the bottom of the member 103 prevents or retards withdrawal of the member 103 through the central opening 105 in the recess 107. A funnel-shaped guide 111 cooperates with the sloped wall of the rim 109 to permit assembly of the telescoping member in the central opening 105. The sliding member has a central opening 113 that leads to an enlarged orifice 115, through which a lead towelette is pulled from the center of the roll 44. A top 117 of the sliding member 103 substantially fills the central depression 107. A hinged handle 116 extends upward from the top 117, and a throat 118 extends downward and has an inward rib 119, which snaps over an outer edge of the guide 111 to retain the telescoping member in inward position, as shown in FIG. 16.

When using the telescoping member, the cap may be removed and the innermost towelette on the roll 44 maybe fed through the central opening 113 and out through the orifice 115 to start the dispensing. Lifting bail 116 raises the telescoping member 103 and the orifice 115, and makes the innermost towelette available for pulling from the orifice. As the towelette leaves the orifice and pulls the end of the next towelette through the orifice, increased resistance causes the towelette bridges to break, leaving the second towelette partially exposed for pulling outward through the orifice. Simply pushing in on the top 117 of the telescoping member 103 closes the container.

Figure 17:
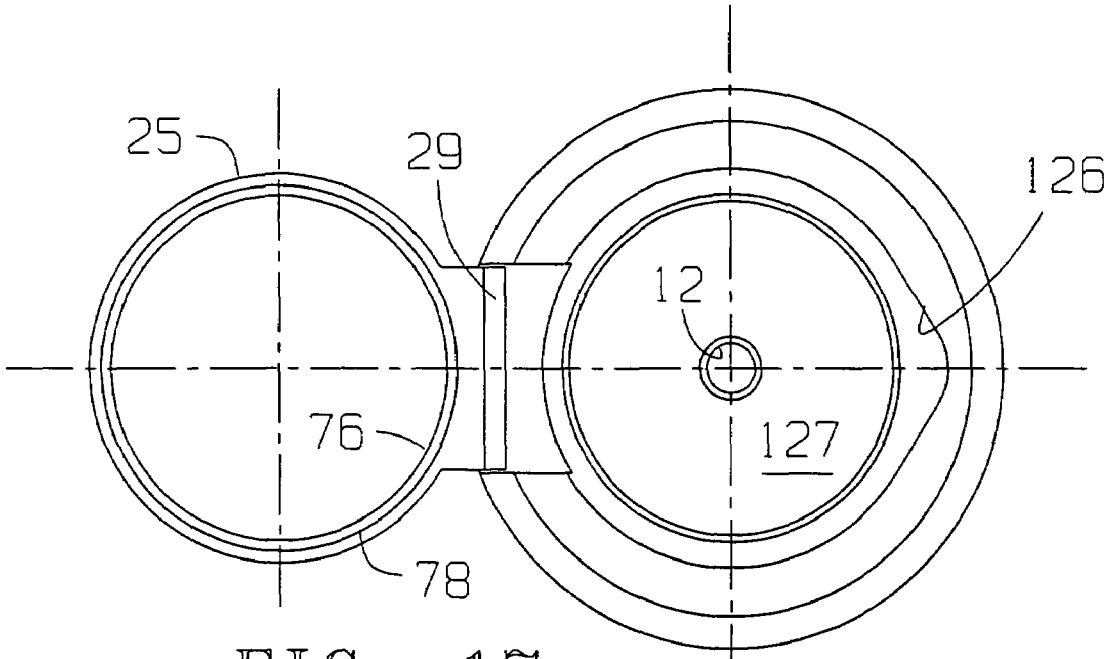
FIG. 17 is a plan view elevation of a dispensing cap thermoplastic elastomer dispenser orifice for towelettes.
Figure 18:
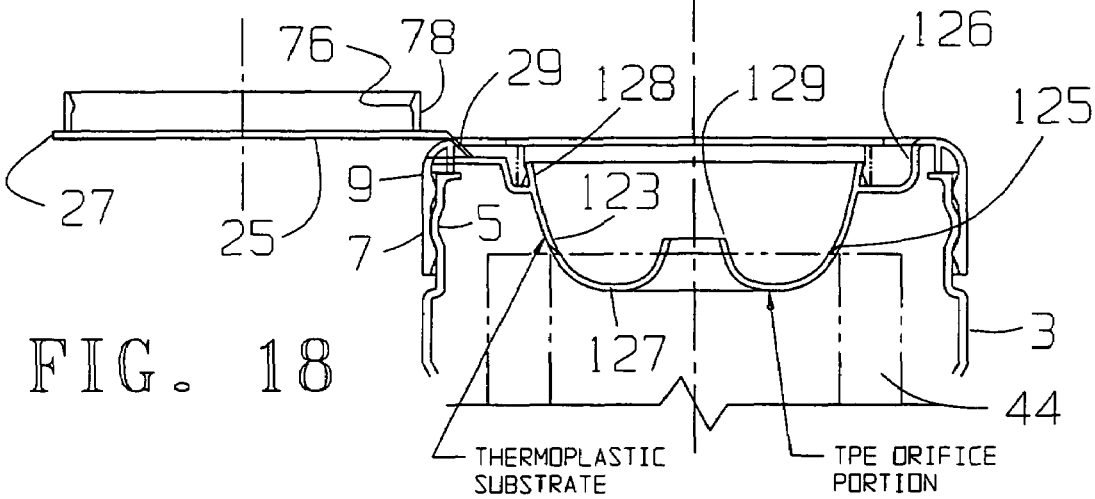
FIG. 18 is a cross-sectional view of the dispensing cap shown in FIG. 17.

One cap 121, as shown in FIGS. 17 and 18, has an integrally molded central dish 123, which is connected at parting line 125 with a soft, relatively flexible orifice portion 127, which contains the orifice 129. Reaching down through the orifice 129 stretches the orifice and allows the user to grasp the innermost towelette on roll 44 and pull the towelette through the orifice. As the next succeeding towelette begins to pull through the orifice, the resistance increases and the bridges between the towelettes tear, leaving a short portion of the successive towelette on top of the orifice. Closing the cover 25 around living hinge 29 enables the inward-extending rim 76 on throat 78 to engage the outward extension 126 on the portion 128 of the thermoplastic substrate 123, which extends above the shelf 122. A recess 126 permits the lifting of the remote edge 27 of the cover when the cover is closed.

Figure 19:
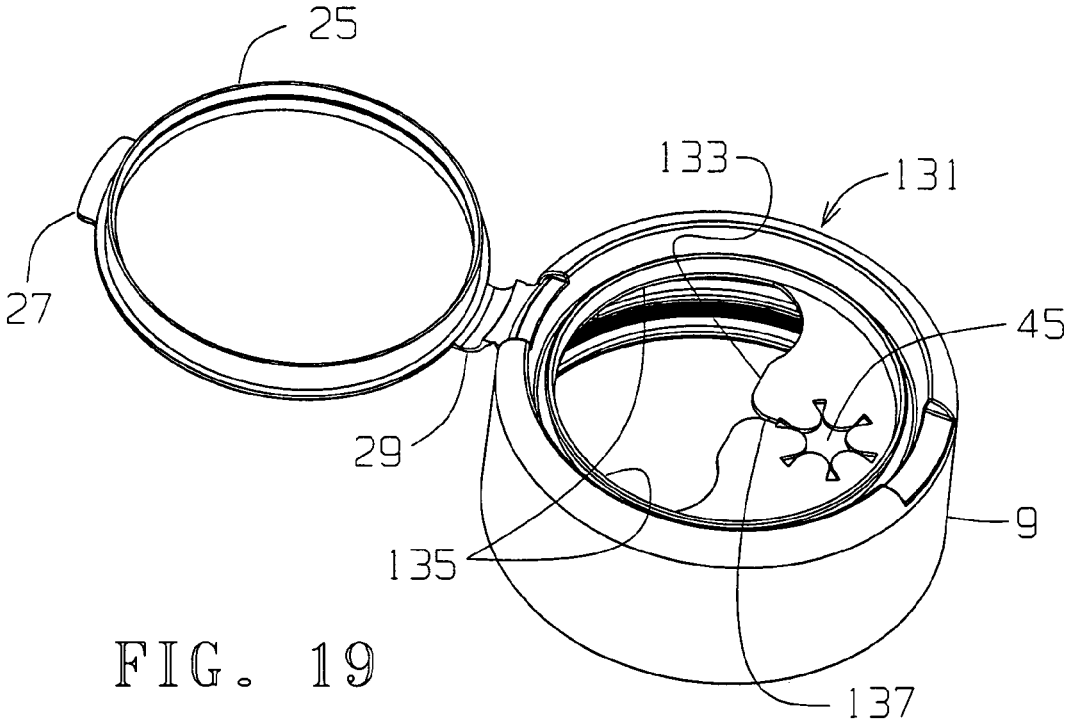
FIG. 19 is a perspective view of a dispensing cap.

In one embodiment of the invention shown in FIG. 19, cap 131 has a sidewall 9 and an inward extending orifice shelf 133, in which the orifice 45 is formed. A large opening 135 is provided in the cap 131 through which the innermost towelette in the underlying roll may be grasped and slid laterally through a slot 137 into the orifice 45. Cover 25 is mounted on living hinge 29 to close the cap 131 and the underlying container.

FIGS. 20-24 show varied orifices and lobe shapes.

FIG. 20 shows an orifice 45 with five lobes 17 and five thin triangular recesses 19 extending radially from the center of the orifice.

FIG. 21 shows an orifice 45 with six similar lobes 17 spaced between triangular shaped recesses 19 leading outward from the center of the orifice.

FIG. 22 shows a circular orifice 145 with four curved lobes 147 between four curved slots 149.

FIG. 23 shows an orifice 45 similar to the orifice shown in FIG. 20, with five lobes 17 and with enlarged radial recesses 19.

FIG. 24 shows an orifice 45 with round laterally touching lobes 17 and circumferentially enlarged recesses 19.

FIGS. 25 and 26 show an orifice 45 similar to the orifice shown in FIG. 20, with five lobes 17 and five triangular radially extending recess slots 19 formed in an orifice thermoplastic shelf 151. Immediately beneath the shelf is a TPE layer 153 with radial slits 155, which cooperate with the orifice 145 to allow passage and encourage gripping of the innermost towelette.

Figure 27:
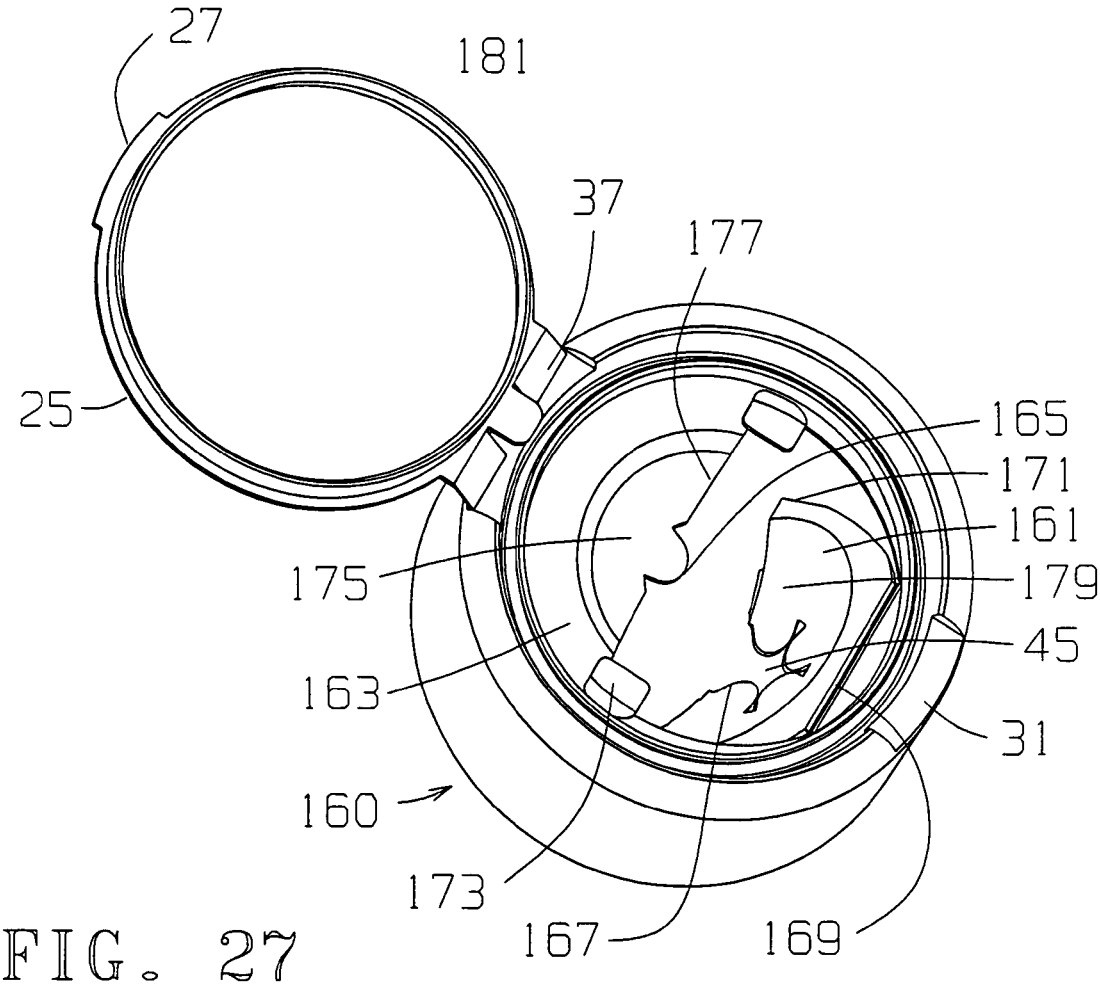
FIG. 27 is a perspective view of a single trap door embodiment.
Figures 28, 29, 30, 31:
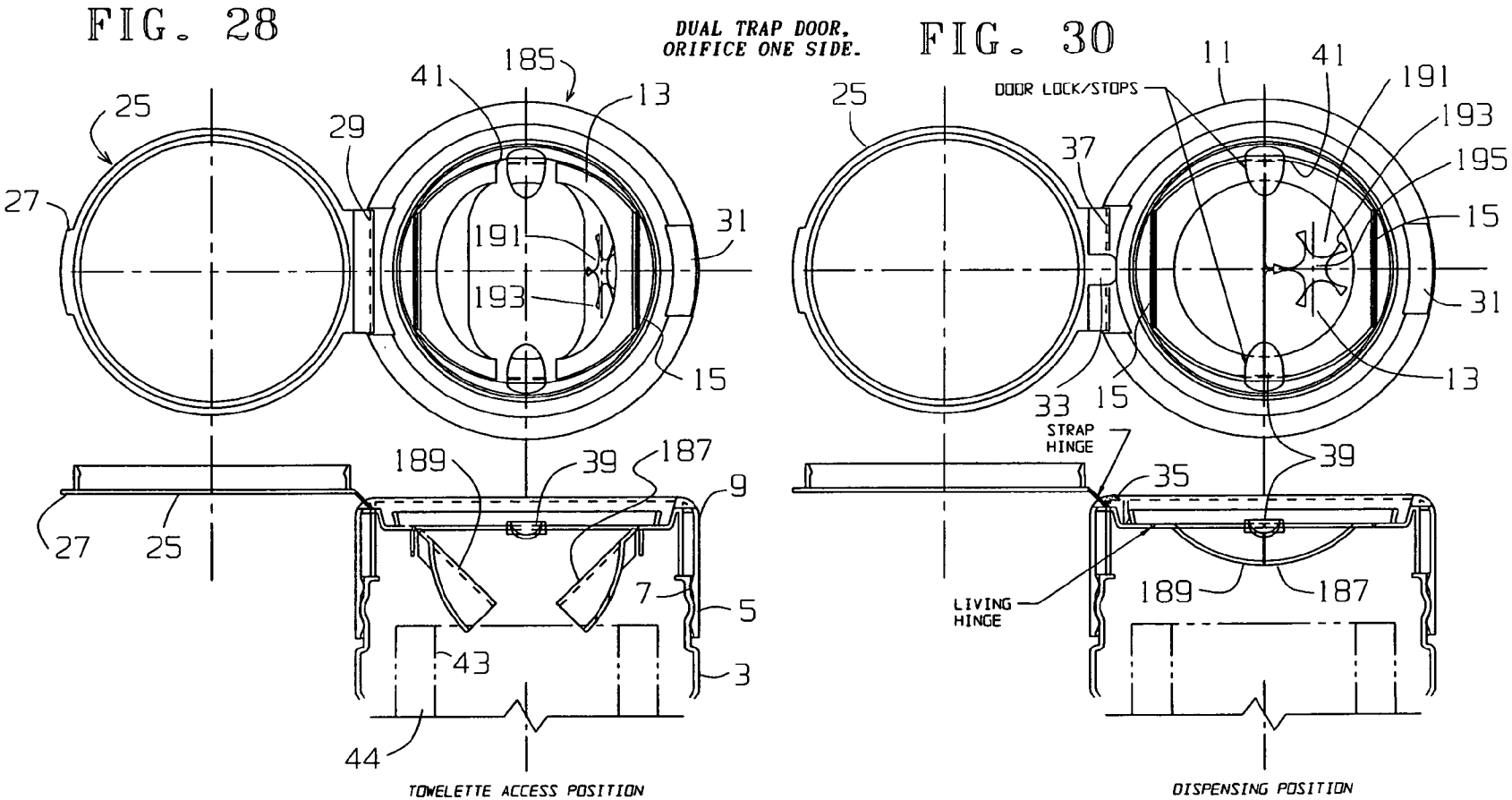
FIG. 28 is a top view of an open dual trap door embodiment with an orifice on one side.
FIG. 29 is a side view of an open dual trap door embodiment with an orifice on one side.
FIG. 30 is a top view of a closed dual trap door embodiment with an orifice on one side.
FIG. 31 is a side view of a closed dual trap door embodiment with an orifice on one side.

FIG. 27 shows a single trap door embodiment 160 that has an orifice 45 formed between the trap door 161 and the stationary part 163 and particularly between a lobe 165 formed on the stationary part and lobes 167 formed on the trap door. The trap door swings inward, around living hinge 169. Upward travel is limited by lugs 173 on the stationary part 163 that overlap sides 171 of the trap door 161.

A central depression 175 formed by depressions 177 and 179 in the stationary part and trap door allow part of the next towelette to remain above the orifice 45 when the cover is closed.

In one embodiment, the trap door may flip up or down and may be snapped into its operative position in which the top of a towelette extends through orifice 45.

The embodiment 160, shown in FIG. 27 is similar to the trap door shown in FIGS. 1-4, except that it has only one flip down door instead of two. This single trap door could also flip up as well as down. This additional single door that flips down or up enables the innermost towelette, from a roll, to be started through the orifice.

The rim 181 on cover 25 tightly fits within opening 183 in the cap 160 to seal the container.

Referring to FIGS. 28-31, a dual trap door embodiment of the invention is generally referred to by the numeral 185. A container 3 has an open upper end 5 that is configured to receive a complementary lower end 7 of the cylindrical wall 9 of the dispenser 185. The dispensing top 11 has two trap doors 187, 189 pivoted on living hinges 15. One trap door 187 has a dish shape with five product-engaging lobes 191 and with enlarged radial recesses 193. The other door 189 does not have any product-engaging regions. An orifice 195 is located completely on one trap door 187. This trap door 187 has a slit 197 for easy threading of a towelette 43 from a roll 44. Both doors 187, 189 open to allow a user to reach into the container 3 and thread the next towelette 43 through the orifice 195.

A cover 25 with a lifting tab 27 is joined with the top 11 about a living hinge 29. The tab 27 lies within a recess 31 when closed.

In another dual trap door embodiment, an inward-extending tab 33 cooperates with a rim 35 on the top of the container and extends between two living hinges 37 to assist in holding the cover 25 fully opened or fully closed. Door lock stops 39 extend inward from the central opening 41 to prevent upward travel of the dish-shaped halves 13. When accessing the inner towelette 43 in a roll 44, an index finger and a thumb push inward on the dish-shaped halves 13, which rotate around the living hinges 15 to allow pinching of the top of the innermost towelette 43, and lifting the towelette upward. The lobes 191 and radial recesses 193, located on only one of the trap doors 187, allow the innermost towelette 43 to be pulled through a slit 197 and a central opening 195.

Towelettes in the roll 44 are joined together by four or five small bridges. As the next adjacent towelette 43 passes through the central opening 45, the lobes 191 and radial recesses 193 grip and slow the next adjacent towelette while the bridges rupture by continued pulling of the first towelette. The result is that the second towelette protrudes slightly through the opening 195 so that it may be gripped between a thumb and index finger when the next towelette is desired. Between uses, the cover 25 is snapped into closed position, retaining the moisture in the towelettes.

Figures 32, 33:
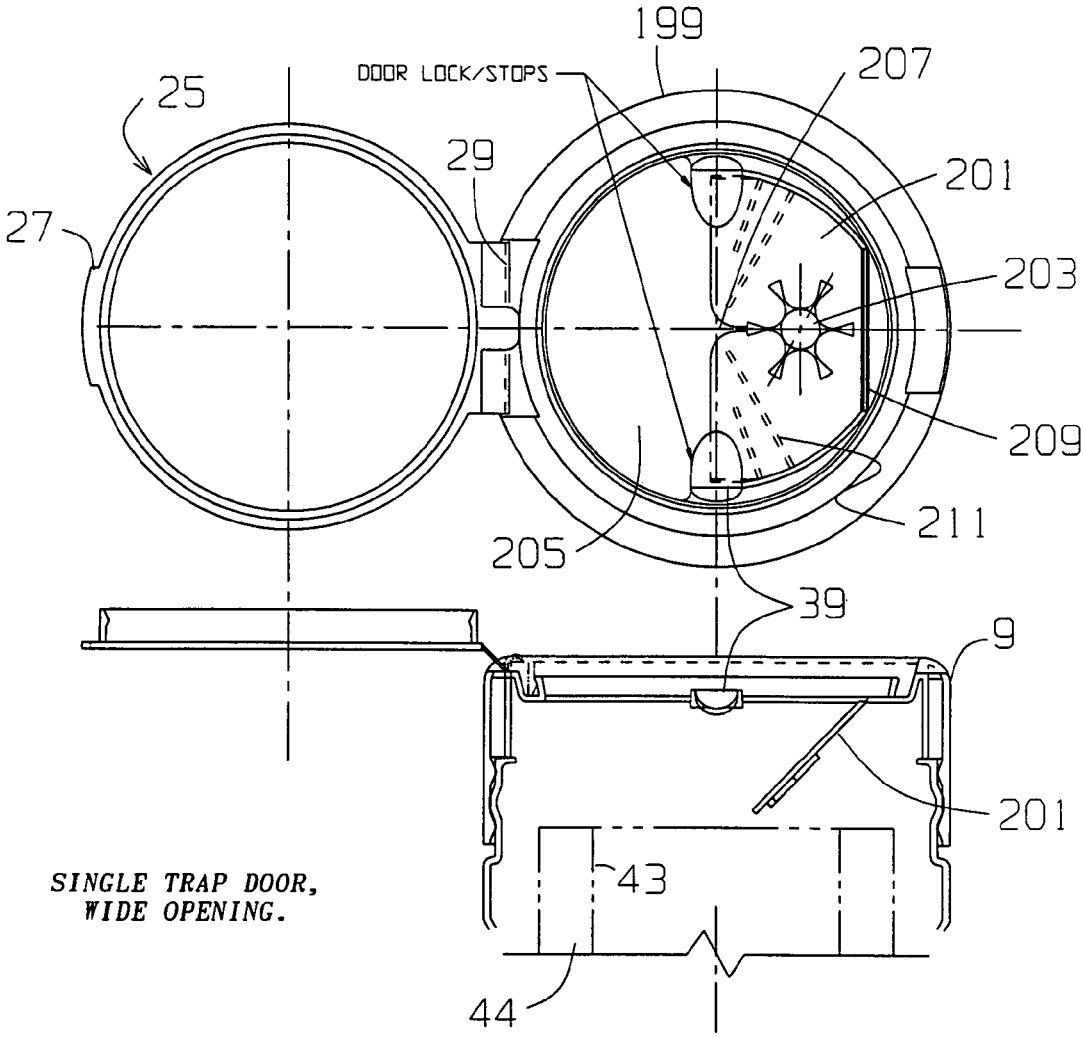
FIG. 32 is a top view of a single trap door embodiment with a wide opening.
FIG. 33 is a side view of a single trap door embodiment with a wide opening.

In a further embodiment of the invention, as shown in FIGS. 32 and 33, a cap 199 has a sidewall 9 and a single inward extending trap door 201, in which an orifice 203 is formed. The trap door 201 is connected to the container via a living hinge 209. The trap door 201 has stiffening ribs 211 on the underside of the trap door 201 for added structural support. A large opening 205 is provided in the cap 199 through which the innermost towelette 43 in the underlying roll 44 may be grasped and slid laterally through a slot 207 into the orifice 203. The trap door 201 opens by pivoting down along the living hinge 209 during towelette retrieval and snaps back into position with door locks 39 for dispensing. The opening of the trap door 201 allows for easier access to the roll of towelettes 44. A cover 25 is mounted on a living hinge 29 for closing the cap 199 and the underlying container.

While the invention has been described with reference to specific embodiments, modifications and variations of the invention may be constructed without departing from the scope of the invention.

The invention claimed is:

1. Dispenser apparatus for towelettes, comprising a series of towelettes joined end to end with relative weak bridges, a container holding the series, an open end on the container, and a towelette dispenser connected to the open end, the towelette dispenser having an opening with restrictions for allowing individual towelettes from the series to pass through the opening, the restrictions holding a leading end of a towelette while a preceding towelette is pulled away from the opening for breaking the bridges between the ends of the towelettes, the towelette dispenser being movable with respect to the open end of the container for reaching into the container through the open end and pulling a towelette from the series into the opening, further comprising a cap connected to the open end of the container, wherein the dispenser further comprises a flap hinged into the cap, and further comprising a cover hinged on the cap for closing over the hinged flap and sealing the open end of the container, wherein the opening is in the flap and the flap is slit opposite the hinge for threading a lead towelette from the series through the slot and into the opening, wherein the opening has a central open area and lobes extending inward from a peripheral area of the opening toward the central open area, and having an enlarged portion of the opening connected to the slit for receiving the leading towelette, further comprising a center support lobe extending from an inner edge of the cap opposite the hinged connection of the flap for cooperating with and blocking at least a part of the enlarged portion of the opening to hold and permit outward passage of a lead towelette.

2. Towelette dispenser apparatus of claim 1 further comprising:

a lid connected to the container positioned over the open end of the container, wherein the opening in the flap is an orifice in the lid for passing towelettes out of the container, one or more lobes protruding into the orifice, wherein a first towelette and a leading portion of a subsequent towelette are pulled through the orifice, and the connections between the first towelette and the subsequent towelette are separated, and wherein a leading portion of the subsequent towelette remains outside of the lid and secured within the orifice.

3. The apparatus of claim 2, wherein the lid further comprises a stationary lid and a hinged door cooperating with the stationary lid, and the orifice is formed between the door and the stationary lid, wherein the lobes are on the door and on the stationary lid, wherein the lobes on the door cooperate with the lobes on the stationary lid for holding the leading portion of a towelette, wherein the trap door is connected to the lid by a living hinge, further comprising door lock stops for holding the door in a dispensing position, a central depression in the lid for holding the leading portion of a towelette when the cover is closed, lugs for controlling movement of the door, and wherein the orifice and lobes are located only on the door, further comprising a slit from the edge of the trap door to the orifice.

4. The apparatus of claim 2, wherein the lid comprises a lower lid and an upper lid, wherein the lower lid is permanently fixed within the container and the upper lid is connected to the container by a living hinge, wherein the lower lid has a lobe extending into an opening, wherein the upper lid and cover are hinged on opposite sides of the container, wherein the lower and upper lids are sealed under the cover when the apparatus is not in use, wherein the upper lid has the orifice and lobes, wherein closing the upper lid pinches a leading portion of the first towelette between the lobe on the lower lid and the lobes on the upper lid, further comprising a split in the upper lid for threading towelettes.

5. The apparatus of claim 2, further comprising parallel V-shaped brackets on an inner surface of the cover, outward extending pins on a detachable hinge complementary to the parallel V-shaped brackets, a hinge plate connected to an orifice plate by a living hinge and wherein the orifice plate is connected to the container by a living hinge, wherein closing the cover folds the living hinge between the hinge plate and the orifice plate and folds the living hinge inward toward the center of the container, wherein opening the cover unfolds the living hinge until the hinge plate and the orifice plate are in the same plane, wherein the hinge plate is detachably hinged to the parallel V-shaped brackets via the outward extending pins, wherein the orifice and lobes are on the orifice plate, wherein the orifice and lobes are on the hinge plate, and wherein the orifice and lobes are formed at the intersection of the hinge plate and orifice plate.

6. The apparatus of claim 2, wherein the lid further comprises a hole and a telescoping member movable through the hole and wherein the orifice is in the telescoping member for holding the leading portion in the telescoping member, further comprising one or more rims around the telescoping member for preventing the telescoping member from falling into the container and from being completely extracted from the lid, a central opening in the telescoping member leading to the orifice, a hinged handle on an outer end of the telescoping member for moving the telescoping member, a rib for retaining the telescoping member in a fixed position, and a central molded dish within the lid with the orifice within the dish, wherein the dish is made of soft, relatively flexible material, and wherein reaching through the orifice stretches the orifice and allows the user to grasp a towelette.

7. The apparatus of claim 1, wherein the orifice is offset from the center of the lid, further comprising a second orifice large enough for a user to reach into the container and retrieve a towelette, and a slit leading from the first orifice to the second orifice for threading a towelette.

8. The apparatus of claim 1, wherein the flap and the cover are hinged to the cap respectively by first and second living hinges at spaced positions on the cap, wherein the flap is hinged on a hinge extending within the cap, and further comprising a ledge extending inward from an inner edge of the cap opposite the hinge, wherein the flap rotates on the hinge inward in the container, and wherein the ledge prevents outward movement of the cap, wherein the cap is removable from the open end of the container and attachable to an open end of another container, and wherein the cap is removable from the open end of the container for filling the container with a replacement series of towelettes.

9. Towelette dispenser apparatus of claim 1 further comprising:

wherein the opening flap is an orifice, one or more rounded lobes extending inward from the dispenser and protruding into the orifice, wherein a first towelette and a leading portion of a subsequent towelette are pulled through the orifice among the lobes protruding into the orifice, and the connections between the first towelette and the subsequent towelette are separated as a first towelette is pulled from the container through the orifice and along the lobes, and wherein a leading portion of the subsequent towelette remains outside of the dispenser and secured by the lobes protruding within the orifice.

10. The apparatus of claim 9, wherein the dispenser has an edge connected to the lid and an opposite free edge, and further comprising a slot extending through the free edge of the dispenser and into the orifice

11. The apparatus of claim 10, wherein the free edge of the dispenser has a convergent shape leading to the slot for guiding a towelette into the slot.

12. The apparatus of claim 9, wherein the dispenser is an inward extending dispenser shelf in which the orifice is formed, and further comprising a large opening adjacent the shelf, through which opening an innermost towelette in the underlying roll may be grasped, lifted and slid laterally through the slot into the orifice.

13. The apparatus of claim 9, wherein the dispenser has an edge connected to the lid and an opposite free edge, and further comprising a slot extending through the free edge of the dispenser and into the orifice.

14. The apparatus of claim 9, wherein the free edge of the dispenser has a convergent shape leading to the slot for guiding a towelette into the slot.

15. The apparatus of claim 9, wherein the dispenser is an inward extending dispenser shelf in which the orifice is formed, and further comprising a large opening in the cap adjacent the shelf, through which opening an innermost towelette in the underlying roll may be grasped, lifted and slid laterally through the slot into the orifice.

* * * * *